United States Patent [19]

Tappan et al.

[11] Patent Number: 4,508,319

[45] Date of Patent: Apr. 2, 1985

[54] BENDER BOARD MOUNTING SYSTEM

[76] Inventors: R. Warner Tappan; Pam R. Tappan, both of 27265 Calle Anejo, Capistrano Beach, Calif. 97624

[21] Appl. No.: 553,588

[22] Filed: Nov. 21, 1983

Related U.S. Application Data

[63] Continuation-in-part of Ser. No. 470,966, Mar. 1, 1983, abandoned.

[51] Int. Cl.[3] ..... E04H 17/14

[52] U.S. Cl. ..... 256/19; 256/13.1; 256/1; 47/33

[58] Field of Search ..... 256/DIG. 5, DIG. 4, 256/12.5, 19, 1; 405/285, 274, 284, 15; 47/33; 403/256, 232.1, 235, 234, 237, 254

[56] References Cited

U.S. PATENT DOCUMENTS

| | | | |
|---|---|---|---|
| 398,078 | 2/1889 | Peterson | 256/DIG. 4 |
| 1,945,784 | 2/1934 | Myer | 47/33 X |
| 3,867,045 | 2/1975 | Beals | 403/235 X |
| 4,108,562 | 8/1978 | Collard et al. | 403/254 |

FOREIGN PATENT DOCUMENTS

| | | | |
|---|---|---|---|
| 2920609 | 12/1980 | Fed. Rep. of Germany | 47/33 |
| 110008 | 3/1944 | Sweden | 256/12.5 |
| 10588 | of 1900 | United Kingdom | 47/33 |
| 389110 | 3/1933 | United Kingdom | 47/33 |
| 635938 | 4/1950 | United Kingdom | 47/33 |

*Primary Examiner*—Andrew V. Kundrat
*Attorney, Agent, or Firm*—Edward E. Roberts

[57] ABSTRACT

A holder for use in landscaping such as for holding bender board or the like, the holder having a U-shaped channel member fixedly, or separably attached to a stake member. The legs or walls of the channel member are generally rigid yet generally resilient and may be equipped with inwardly extending hook-like tabs or tangs to firmly grip the board or the like within the channel. The stake member may have barbed portions for impeding withdrawal of the holder from the ground. The holder may be formed of galvanized sheet metal.

12 Claims, 11 Drawing Figures

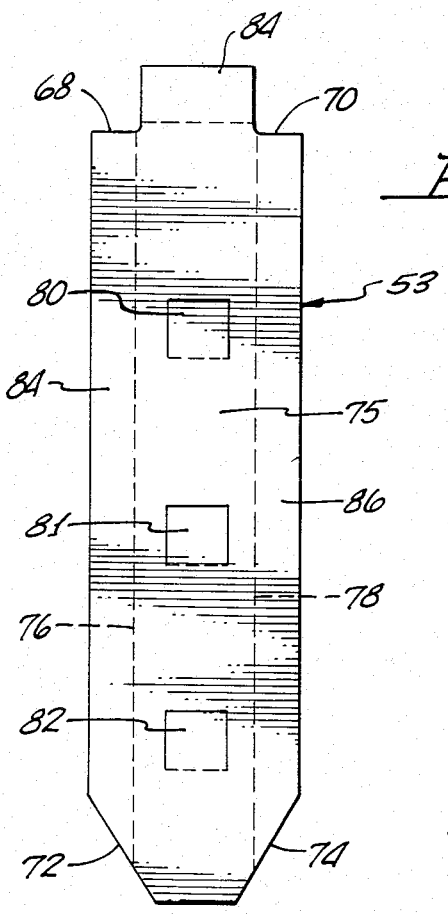
FIG. 9.
FIG. 10.
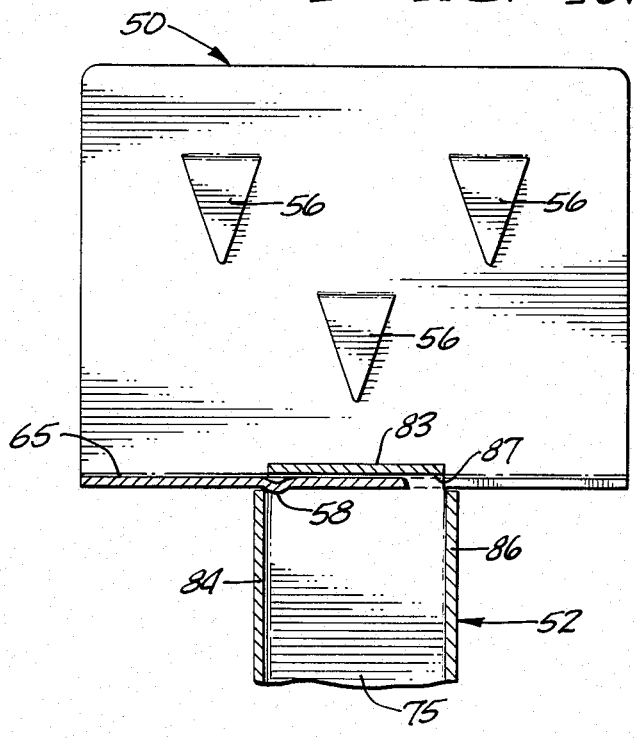
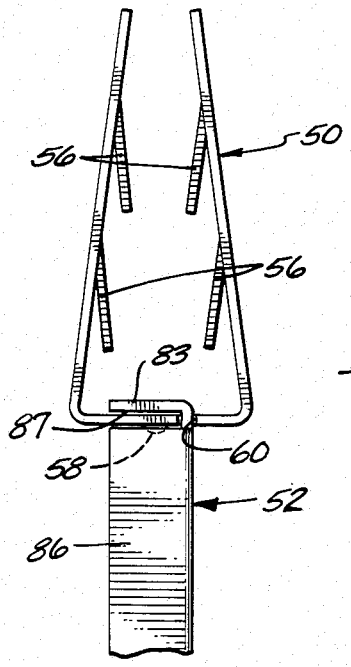
FIG. 11.

BENDER BOARD MOUNTING SYSTEM

CROSS-REFERENCE TO RELATED APPLICATION

This application is a continuation in part of U.S. Patent Application Ser. No. 470,996, entitled "Bender Board Mounting System" by R. Warner Tappan and Pam R. Tappan, filed on Mar. 1, 1983 and now abandoned.

BACKGROUND OF THE INVENTION

The background of the inventin will be discussed in two parts:

1. Field of the Invention

This invention relates to holders for thin wood or plastic strips, and more particularly to holders for bender boards used in landscaping construction or the like.

2. Description of the Prior Art

Landscaping architecture often involves the construction of lawns or planting beds with curved contours. These contours are traditionally defined by thin, flexible bender boards set on edge along the ground, and held in place by nailing them at intervals to wooden hubs or stakes driven into the ground. Soil is then backfilled against the bender board to form the bed.

In assembling such curved contours, the hubs or stakes are typically pounded into the ground on one or both sides of the wooden strip. If attempts are made to nail the strip to the hubs or stakes, the stake is loosened, thus weakening its hold in the ground. In addition, any hammering into subsequent stakes in proximity to a given stake will likewise cause loosening of the stake as well as the assembled contour edging, while also causing cracking of the strip itself.

Although, the traditionl method is generally satisfactory, it has other disadvantages. Because of the outward pressure of the backfill against the bender board, the stakes have to be on the outside of the bed, where they are unsightly. The conventional wooden stakes are also subject to cracking and are awkward to handle. If carelessly driven in, they will protrude above the upper edge of the bender board and present a hazard.

Landscape architectural devices in the prior art tend to focus on such problems as lawn edging devices or tree and shrub surrounding devices. In the latter category, U.S. Pat. No. 2,782,561, entitled "Tree Surrounding Ring", issued to Smith, shows and describes a ring formed in arcuate segments with downwardly depending projections and interlocking means. U.S. Pat. No. 425,890, entitled "Border for Flower Beds" discloses a border with metal stakes with a slot through which a flat metal bender strip can be threaded. The disadvantage of this arrangement is that the stakes necessarily protrude above the bender strip and thereby increase the hazard, and also that it is difficult to thread the resulting strip through the stakes and hold it tightly therein without separate wedges.

In the lawn edging category, U.S. Pat. No. 2,774,357, entitled "Lawn Edging Device", issued to Foote, discloses a channel shaped member configured for defining the edge with a T-shaped member insertable therein. U.S. Pat. No. 3,277,606, entitled "Lawn Edging Material", issued to Cohen, discloses a device having an inverted generally U-shaped base member and a top member coupled thereto. The devices of both patents are attempts to eliminate the more economical wood strip and provide cumbersome, complicated, expensive arrangements.

Other patents which touch on the general subject matter are U.S. Pat. No. 327,717, entitled "Fence", issued to Phillips; U.S. Pat. No. 2,116,426, entitled "Guardrail for Athletic Fields", issued to Cecil; and U.S. Pat. No. 3,768,780, entitled "Fence Border", issued to Cowles et al. Such prior art patents disclose fence, guard rail and border constructions, and are referenced for completeness.

It is thus an object of the present invention to provide a new and improved holding device for retaining wood strips, and particularly a new and improved bender board holder which can be driven into the ground, and which resiliently grasps the bender board adjacent its lower edge by means of inwardly biased channel legs.

It is a further object of the present invention to provide a new and improved holder of the type described which is capable of holding the bender board in place without nailing.

SUMMARY OF THE INVENTION

The foregoing and other objects of the invention are accomplished by providing a holder which has a stake portion adapted to be driven into the ground. The stake portion supports a U-shaped channel whose web is flush with the ground, and whose legs resiliently receive and hold the bender board along the lower portion thereof. In the various embodiments, the channel portion may be secured to the stake portion, as by welding, or may be separably and separately formed. Inwardly extending dimples or tang members may be provided on opposing side walls of the channel member for assisting in the retention of the board therein. The stake portion may contain barbs for assisting in its retention within the ground.

BRIEF DESCRIPTION OF THE DRAWINGS

FIG. 9 is a plan view of the blank used to form the stake member of the embodiment of FIG. 7;

FIG. 10 is a sectional view, partially broken away, of the channel member of FIG. 8 shown in assembled relation with the stake member of the embodiment of FIG. 7 to illustrate the interconnection; and FIG. 11 is an end view of the assembly of FIG. 10, partially broken away.

DESCRIPTION OF THE PREFERRED EMBODIMENT

Figure 5:
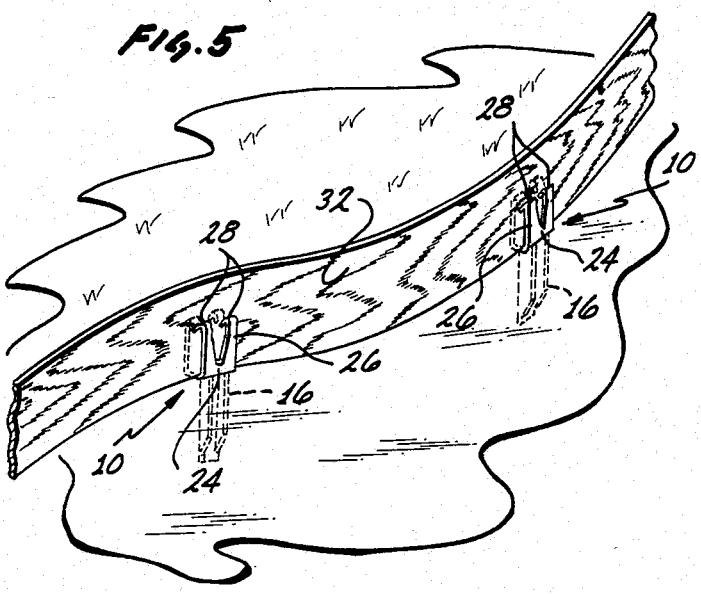
FIG. 5 is a perspective view illustrating the use of the device of FIG. 1.

FIGS. 1–4 show a first embodiment of the invention. The manner in which this embodiment is used is shown in FIG. 5. The holder 10 of this invention has a stake portion 12 and a board-receiving channel portion 14. The stake portion 12 is formed as a smaller channel 16 (See FIG. 4) with a pointed end 18 and inclined barbs 20 which retain the stake portion 12 in the ground. To provide a strong, relatively inexpensive holder, in this embodiment, the portions 12 and 14 are formed of metal and welded together.

Figure 1:
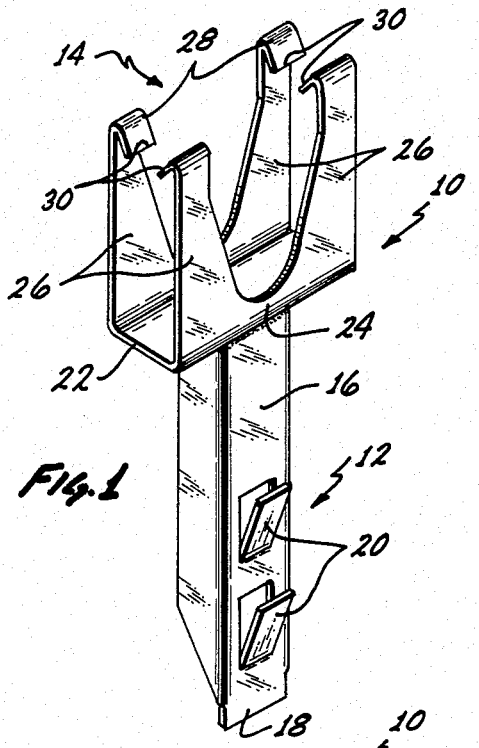
FIG. 1 is a perspective view of a first embodiment of the invention.
Figure 2:
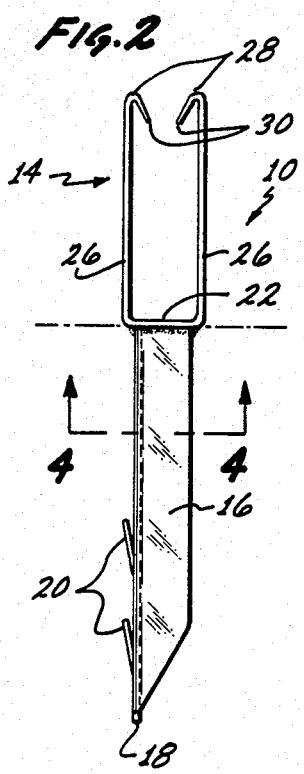
FIG. 2 is a side elevational view of the device of FIG. 1.
Figure 3:
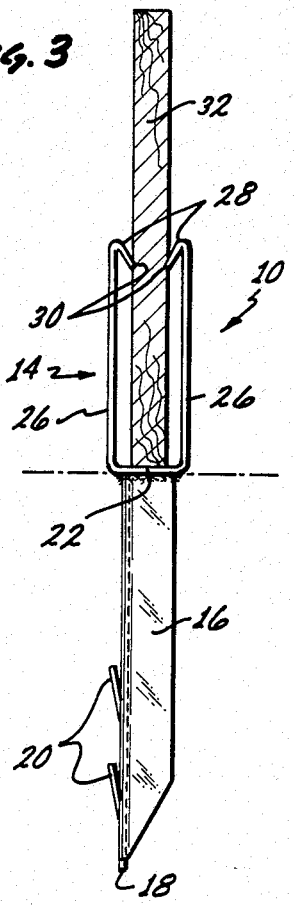
FIG. 3 is a view similar to FIG. 2 but with the bender board inserted.
Figure 4:
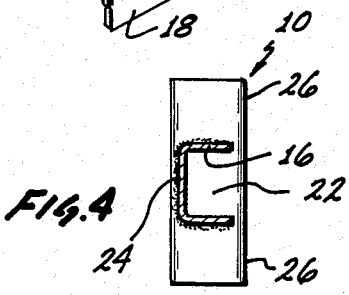
FIG. 4 is a horizontal section along the Line 4—4 of FIG. 2.

The channel portion 14 is attached to the top of the stake portion 12 so that the web 22 will lie flush against the ground when the stake portion 12 is driven into the ground. The legs 24 of the channel 14 are cutout, as best shown in FIG. 1, to provide in each leg a pair of spaced resilient fingers 26. Each of the fingers 26 carries at its end a table 28 pointing inward and downward. The tabs 28 preferably have a sharp edge 30 capable of biting into the bender board 32 when it is inserted into the channel 14 as shown in FIG. 3.

Because the fingers 26 are individually movable transversely of the channel 14, the holder 10 can accommodate warpage and irregularities of the board 32. For the same reason. it is also less critical for the holder 10 to be straight when driven into the ground. When the board 32 is pushed down into the channel 14, the tabs 28 will grip it uniformly and prevent it from slipping out.

Figure 6:
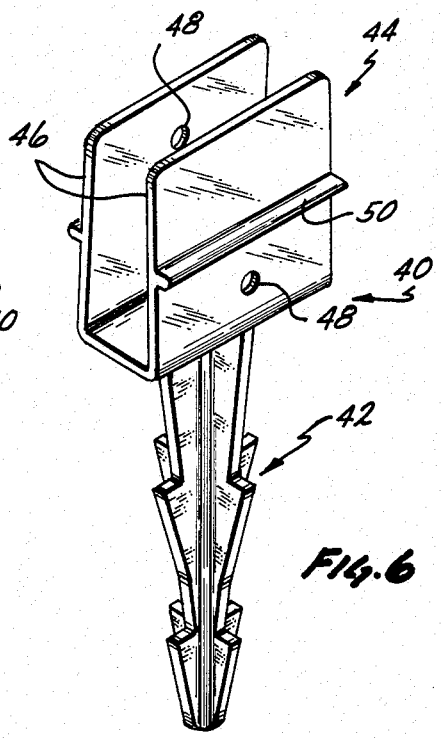
FIG. 6 is a perspective view of an alternate embodiment of the invention.

FIG. 6 shows an alternative embodiment 40 of the holder 10. In this embodiment, the barbed shank portion 42 and the channel portion 44 may be die-cast as a single piece from a suitable plastic material. The legs 46 are resiient and are inclined toward each other so as to grip the board 32 between them when it is slipped into the channel 44. Apertures 48 are formed in the legs 46 to receive fasteners, such as nails, to retain the board 32 in the channel 44, if desired. Ribs 50 are provided in the legs 46 to strengthen them against breakage when the holder 40 is driven into the ground.

Referring now to FIGS. 7 through 10, the preferred embodiment of the invention will be described. In the embodiment shown, the channel 50 and the stake member 52 are formed separately and are connectable and separable while retaining all of the advantages previously described in holding the bender board. The two parts are readily formed as by conventional sheet metal operations, such as stamping, cutting and bending. Complex dies are not required and joining operations such as welding are eliminated.

The channel member 50 is formed from a flat, generally rectangular blank 51 (See FIG. 8) of sheet metal (preferably galvanized) which is stamped to form the tanges 56 and a dimple 58. A slot 60 is cut into the bight portion 62 of the member 50, slightly offset from the center thereof, and stopping adjacent the dimple 58 which is positioned on the approximate centerline of the bight portion. In FIG. 8, the bend lines are depicted with dotted lines 64 and 66. The blank 51 may then be bent into the U-shaped channel configurations shown with the tangs 56 extending inwardly and downwardly from opposing sidewalls of the channel member 50 for gripping the wood strip inserted therein. As shown in FIG. 10, the dimple 58 protrudes downwardly from the bight portion 65 of the channel member 50. With a single pass of a die, the tangs 56 and the dimple 58 are formed, with the slot 60 being formed by cutting, or alternatively by punching. The blank 51 may then be bent into the configuration depicted in FIG. 7, as part of the same operation, or by a separate operation. Upon bending, as shown in FIG. 11, the opposing walls of the channel member 50 are tapered inwardly at the open end thereof to assist in gripping the board therebetween, the walls spreading slightly on insertion due to the resilience of the assembly, and the material employed.

The stake member 52 is likewise formed of a generally rectangular elongate blank 53 of sheet metal (See FIG. 9) with the upper corners 68 and 70 thereof notched for bending, and the lower edges 72 and 74 thereof angularly cut to form a sharp portion for insertion after bending. The vertical dotted lines 76 and 78 generally depict the bend lines. Tangs 80–82 inclusive are formed within the spine portion 75 between the dotted lines 76 and 78, with the tangs formed angularly upwardly and outwardly to inhibit removal after insertion. The required notching, angle cutting and formation of the tangs 80–82 may be conveniently accomplished with a single die operation, and by use of a second die, the bending can be accomplished. After bending, the stake member 50 has a generally C-shaped channel cross-sectional configuration providing strength and rigidity.

Figure 7:
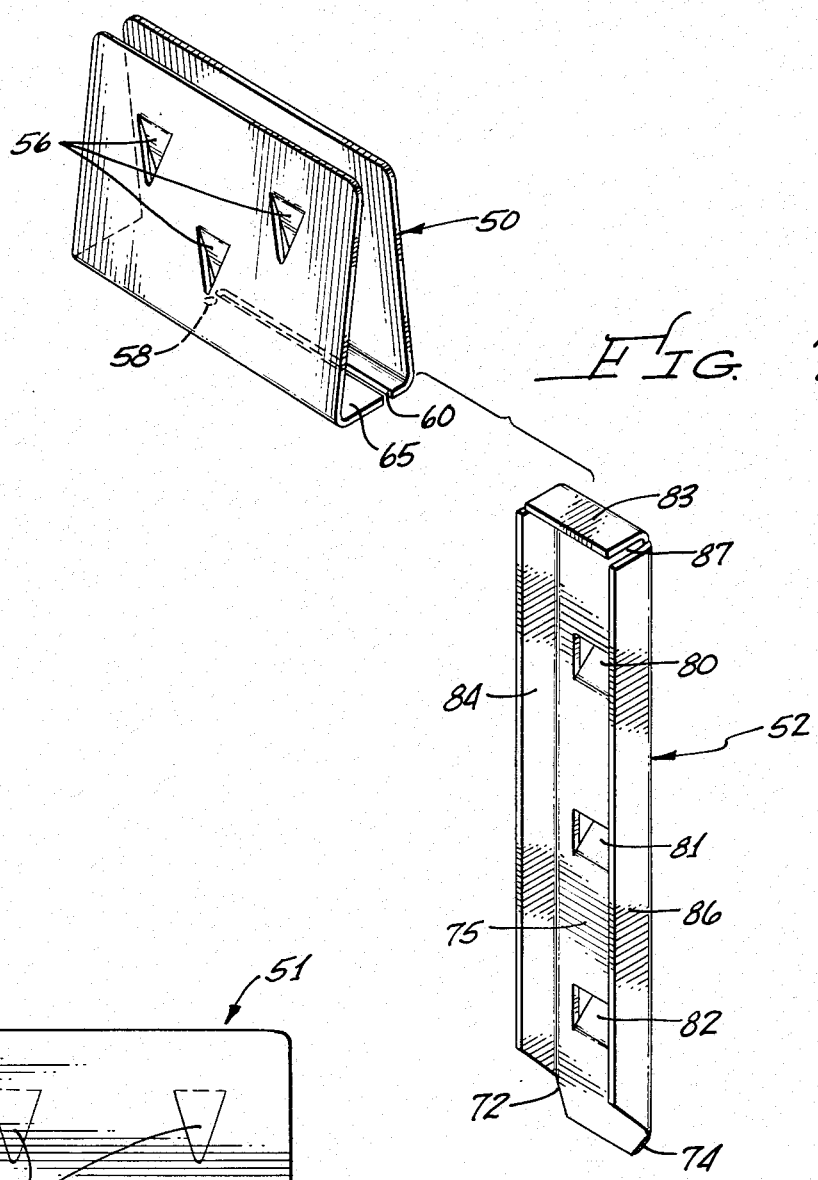
FIG. 7 is an exploded perspective view of a preferred embodiment of the holder in accordance with the invention.
Figure 8:
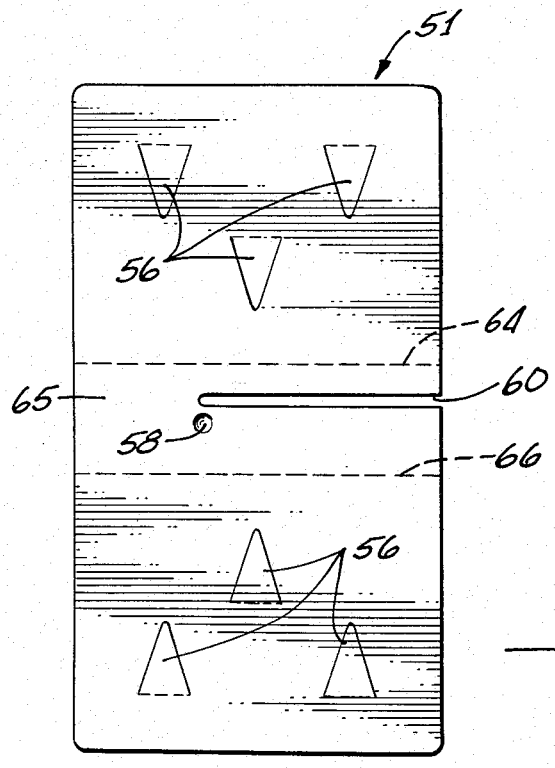
FIG. 8 is a plan view of the blank used to form the channel member used in the embodiment of FIG. 7.

Once the two blanks 51 and 53 are bent, the channel member 50 and the stake member 52 appear as illustrated in FIG. 7 ready for assembly. As shown, the upper end of the stake member 52 has the tab portion 83 thereof bent to form a slot 87 which approximates the width of the bight portion 65 of the channel member 50. The spine portion 75 of the stake member 52 is inserted into the offset slot 60. Due to the offsetting of the slot 60, insertion is possible in only one way, and that is with one of the sidewalls 84 and 86 of the stake member 52 being forced into coaction with the dimple 58.

By referring to FIGS. 10 and 11, the coaction will now be described. As the stake member 52 is forced into the slot 60 of the channel member 52, the upper edge of sidewall 84 is met with resistance at the point of contact with the dimple 58. By applying an additional force, the edge of sidewall 84 passes over the dimple to provide the interlock depicted in FIG. 10. As shown in front elevation with full insertion, the stake member 50 is generally centrally positioned relative to the width of the channel member 52, with the slot 60 and dimple 58 being cut, positioned and dimensioned to effect this result. FIG. 11 illustrates the assembled parts in side view, showing the stake member 52 generally centrally aligned relative to the bight portion of the channel member 50, thus providing a rigid structure for insertion into the ground and retention of the bender board 32.

With the holder of the present invention, double staking of the bender board 32 is eliminated, thereby facilitating more rapid and less expensive installation. Since a number of the holders can be readily inserted along the contoured path where desired, and the bender board then inserted, one person can accomplish the task without assistance. By having barbed stake members 52, the installed benderboard will not raise out of the ground after installation, and with the height of the walls of the channel member 50 being less than the normal height of the benderboard, a smooth aesthetically pleasing appearance is achieved. Once the holder is inserted into the ground, the bight portion of the channel member abuts against the ground providing addition structural support not previously obtainable with the prior art wooden stake or hub method.

Although the preceding description of the preferred embodiment has proceeded with reference to the use of sheet metal blanks, it is to be understood that other methods of fabrication may be used, and other generally rigid, yet resilient materials may be conveniently employed. For example, plastic extrusions or molded parts may be utilized to form the channel members as well as the stake members. Additionally, although the description hereinabove has referred to the use of the holding device as a bender board holder, it is to be understood that the holder may be used for retaining a wooden slat at an end thereof for maintaining it in an upright position, such as a slat for supporting plants such as flowers or tomato plants. While there has been shown and described preferred and alternative embodiments, it is to be understood that various other adaptations and modifications may be made within the spirit and scope of the invention.

We claim:

1. In a device for holding boards or the like in generally fixed relation to the ground, the combination comprising:

(a) a stake member configured for insertion into the ground, said stake member including slot means adjacent one end thereof; and (b) a generally U-shaped channel member having a bight portion configured for attachment to said stake member and a pair of generally resilient, generally vertical leg portions for receiving and holding a board or the like therebetween, the bight portion of said channel member being slotted for engagement with said slot means for separably interconnecting the two parts.

2. The combination according to claim 1 wherein at least one of said stake member and said channel member include interlock means for at least partially securing the parts in assembled relation.

3. The combination according to claim 2 wherein said interlock means includes a dimple in the bight portion of said channel member for engaging a portion of said stake member adjacent said slot means.

4. The combination according to claim 1 wherein said stake member and said channel are formed of metal.

5. The combination according to claim 1 wherein said stake member and said channel member are formed of bent sheet metal.

6. The combination according to claim 5 wherein said channel member has a slotted opening in the bight portion thereof, and one end of said stake member has a matingly configured slot means for coaction therewith.

7. The combination according to claim 6 wherein said bight portion of said channel member includes means for interlocking said one end of said stake member thereto.

8. The combination according to claim 7 wherein said means for interlocking is a dimple formed in said bight portion for frictionally engaging a portion of said stake member.

9. The combination according to claim 8 wherein said channel member has inwardly extending tang means on the opposing walls thereof for frictionally gripping a board or the like therebetween.

10. The combination according to claim 9 wherein said stake member has a spine portion with tang means formed therein, said tang means being dimensioned and configured for impeding withdrawal of said stake member from the ground.

11. The combination according to claim 10 wherein the opposing walls of said channel member are tapered inwardly at the open end thereof.

12. In a device for holding boards or the like in generally fixed relation to the ground, the combination comprising:

(a) a stake member configured for insertion into the ground, said stake member being formed of sheet metal in an elongate generally C-shaped channel configuration, said stake member having inclined barb portions formed therein in a direction to impede the withdrawal of said stake member from the ground; and (b) a generally U-shaped channel member having a bight portion secured to said stake member and a pair of generally vertical, independently reslient finger members spaced longitudinally of said channel member, the ends of said finger members being bent to form inwardly and downwardly directed tabs on the ends of said finger members for resiliently engaging a board or the like against withdrawal thereof from said channel member.

* * * * *